United States Patent [19]

Edwards, Jr. et al.

[11] 4,020,308

[45] Apr. 26, 1977

[54] COVER ASSEMBLY FOR AN ELECTRICAL SWITCH

[75] Inventors: Stanley H. Edwards, Jr., Weaverville; Cleve L. Reese, Arden, both of N.C.

[73] Assignee: Square D Company, Park Ridge, Ill.

[22] Filed: Apr. 10, 1975

[21] Appl. No.: 566,944

[52] U.S. Cl. ..... 200/310; 339/113 L; 240/2 S

[51] Int. Cl.[2] ..... H01H 9/16

[58] Field of Search ..... 240/2 S, 2 SP, 151, 240/152; 248/27; 200/304, 305, 310, 317; 339/113 L

[56] References Cited

UNITED STATES PATENTS

| | | | |
|---|---|---|---|
| 1,720,463 | 7/1929 | Both | 339/113 L |
| 2,134,695 | 11/1938 | Bigman | 200/310 |
| 2,596,166 | 5/1952 | Peterson | 240/2 SP |
| 2,786,196 | 3/1957 | Haynes | 240/152 |
| 3,115,308 | 12/1963 | Stark | 240/152 |
| 3,340,372 | 9/1967 | Schaefer | 200/83 P |
| 3,489,891 | 1/1970 | Altissimo | 240/152 |

*Primary Examiner*—Gerald P. Tolin
*Attorney, Agent, or Firm*—William H. Schmeling; Richard T. Guttman

[57] ABSTRACT

A removable cover assembly is provided for an electrical switch. The assembly includes a casing having an apertured panel, on the interior surface of which are mounted an illuminating means and elongated contact means, the latter making electrical contact with conductors of the switch when the cover assembly and the switch are in assembled relation. A lens piece is accommodated in the panel aperture and the illuminating means is secured to the portion of the lens piece adjacent the panel interior surface.

4 Claims, 6 Drawing Figures

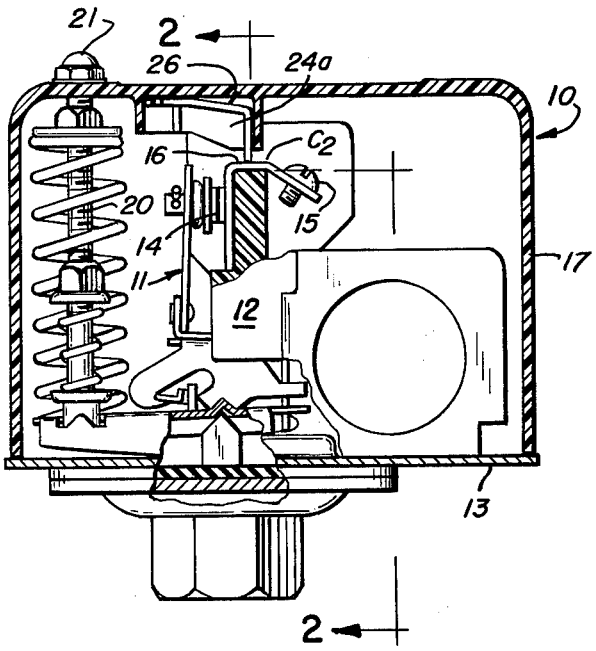
FIG. 1
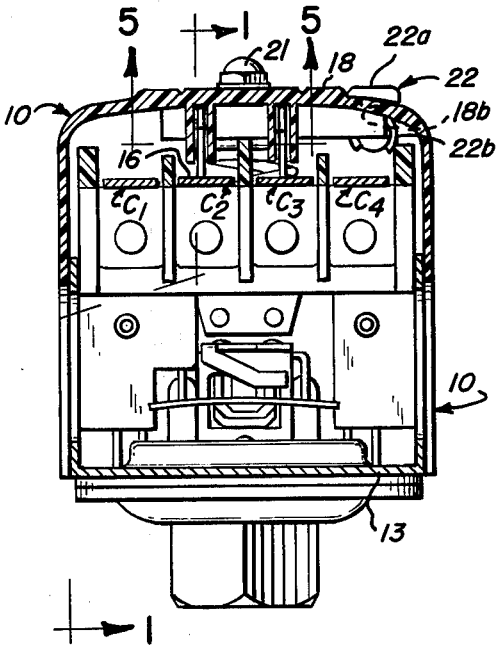
FIG. 2
FIG. 3
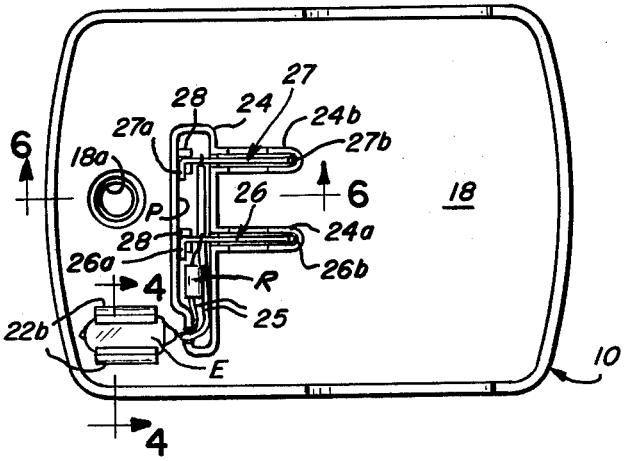
FIG. 4
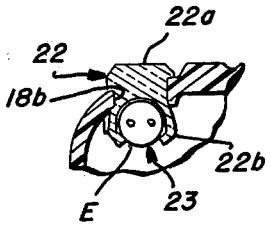
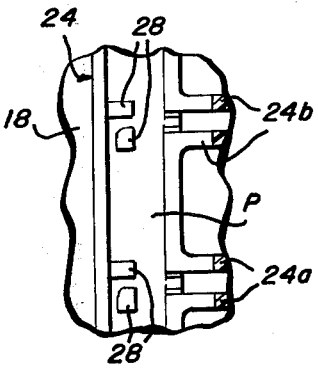
FIG. 5
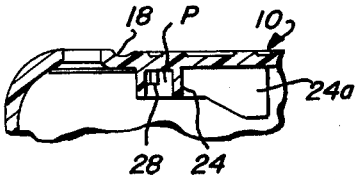
FIG. 6

COVER ASSEMBLY FOR AN ELECTRICAL SWITCH

BACKGROUND OF THE INVENTION

In industrial switches or the like, it is oftentimes desirable to utilize a pilot light or some other illuminating means to readily indicate when the switch is in either an open or closed position. It is also an advantage to have the pilot light carried by the switch over and readily accessible when required for servicing.

SUMMARY OF THE INVENTION

Thus, it is an object of the invention to provide a cover assembly for an electrical switch which is of simple, inexpensive construction and embodies illuminating means which indicates the position of the switch at a given time.

It is a further object of the invention to provide a cover assembly which may be utilized with a variety of switches.

It is a further object of the invention to provide a cover assembly having a minimum number of components which may be readily assembled to form a unitary structure.

Further and additional objects will appear from the description, accompanying drawings and appended claims.

In accordance with one embodiment of the invention, a cover assembly is provided for an electrical switch. The cover assembly includes a casing having an apertured panel, on the interior surface of which is mounted an illuminating means. Also mounted on the interior surface and protruding therefrom is an elongated contact means which is adapted to make electrical contact with switch conductors when the cover assembly and the switch are in assembled relation. Disposed within an aperture of the casing panel is a lens piece to the inner end of which is secured the illuminating means. The interior surface of the panel is provided withh an elongated pocket which extends from the illuminating means to the contact means. Disposed within the panel pocket are connecting means which interconnect the illuminating means and the contact means. The lens piece, illuminating means and contact means are all carried by the casing panel so as to form a unitary structure.

DESCRIPTION

For a more complete understanding of the invention, reference should be made to the drawings wherein:

FIG. 1 is a vertical sectional side view of one form of the cover assembly and a switch in assembled relation and taken along line 1—1 of FIG. 2.

FIG. 2 is a vertical sectional end view taken along line 2—2 of FIG. 1.

FIG. 3 is a view of the cover assembly of FIG. 1 removed from the switch and showing the panel interior surface with the illuminating means, lens piece and contact means mounted thereon.

FIG. 4 is a fragmentary enlarged sectional view of the lens piece and illuminating means taken along line 4—4 of FIG. 3.

FIG. 5 is a fragmentary enlarged sectional view of a portion of the pocket formed in the panel of the casing and taken along line 5—5 of FIG. 2.

FIG. 6 is a fragmentary enlarged sectional view of a portion of the pocket formed in the panel and taken along line 6—6 of FIG. 3.

Referring now to the drawings and more particularly to FIGS. 1 and 2, one form of the improved cover assembly 10 is shown in assembled relation with an electrical switch 11. In the illustrated embodiment, the switch 11 is of a pressure type such as disclosed in U.S. Pat. No. 3,340,372 issued on Sept. 5, 1967. Other types of switches may be utilized, if desired.

Switch 11 embodies a plurality of elongated conductors $C_1$, $C_2$, $C_3$, and $C_4$ which are arranged in aligned, spaced relation and are mounted on a terminal block 12 of non-conductive material. The terminal block is fixedly secured to a suitable base 13 forming a component of the switch. At a corresponding end of each conductor there is provided a contact 14 and at the opposite end of the conductor there is a terminal screw 15. The portion 16 of each conductor intermediate the contact 14 and terminal screw 15 is curved, as seen more clearly in FIG. 1, and faces outwardly.

The cover assembly 10 includes a casing 17 which has an inverted substantially cup-like configuration and is preferably formed of a non-conductive material. When the casing is assembled on the switch, the various components of the switch are substantially concealed within the casing.

The casing 17 is provided with a front panel 18 which is spaced from portions 16 of the switch conductors $C_1$, $C_2$, $C_3$, and $C_4$, see FIG. 2. Panel 18 is provided with a first aperture 18*a* through which a portion of a post 20 extends. An exposed nut 21 is threaded onto the protruding end of the post and retains the casing 17 in assembled relation with the switch. Post 20 is anchored to the switch base 13.

Panel 18 is provided with a second aperture 18*b* which is adapted to accommodate a lens piece 22, see FIG. 2.

The lens piece 22 is preferably molded of light pervious material (e.g. acrylic) and has an exposed end 22*a* which is impassable with respect to the aperture 18*b* and is adapted to engage the exterior surface of the portion of the panel 18 circumjacent the aperture 18*b*. The concealed end 22*b* of the lens piece 22 is sized so that it can initially be inserted through the aperture 18*b* and then expanded so as to grippingly engage an illuminating means 23, the latter being mounted adjacent the interior surface of panel 18. The illuminating means 23 may be a low intensity lammp bulb. The concealed end 22*b* of the lens piece 22 is shaped so as to form fingers which resiliently embrace the envelope E of the bulb, see FIG. 4.

Formed on the interior surface of panel 18 is an elongated pocket P which is delimited by a protruding flange 24. The pocket is adapted to accommodate wire leads 25 which extend from the lamp bulb to a pair of elongated contact elements 26 and 27. Each contact element is formed of resilient bent wire and has one end thereof 26*a* and 27*a* disposed within the pocket P and engaging attaching means 28 formed within the pocket. The opposite ends 26*b* and 27*b* of the contact elements project angularly from the interior surface of panel 18 and are adapted to abuttingly engage the portions 16 of selected conductors $C_2$ and $C_3$, see FIG. 2, when the cover assembly and switch are in assembled relation and, thus, make electrical contact therewith. The wire leads 25 from the lamp bulb are secured by soldering or the like to the contact elements 26 and 27 with a voltage dropping resistor R interposed between one of the leads 25 and the contact element 26.

Once the wire leads 25, the resistor R, and the ends 26*a* and 27*a* of the contact elements are disposed within the pocket P, the latter may be filled with a suitable epoxy, not shown, which will permanently secure the wire leads, resistor R, and contact elements to the interior surface of the casing panel 18. The light bulb as previously mentioned is resiliently gripped by the inner end of the lens piece. Thus, the various components of the cover assembly form a unitary structure, thereby facilitating assembly and disassembly of the cover relative to the switch.

It is to be noted in FIGS. 1–3 that portions 24*a* and 24*b* of the flange 24 which delimits the pocket P function as a shield for the protruding portions of contact elements 26 and 27, respectively.

Thus, it will be seen that a cover assembly has been provided which is simple in construction, may be readily assembled and can be utilized with a variety of switches. The components of the cover assembly are substantially concealed behind the casing panel and the cover assembly is of unitary construction thereby facilitating assembly or disassembly of the cover assembly on a switch.

We claim:

1. A switching device comprising an electrical switch provided with a pair of relatively spaced conductors; and a removable cover assembly mounted on said switch and concealing said conductors, said cover assembly including a panel having exterior and interior surfaces, the interior surface being spaced from said conductors; a unitary lens piece mounted on said panel and having an outer portion engaging the panel exterior surface, an inner portion engaging the panel interior surface, and an intermediate portion extending through an opening formed in said panel; said inner portion including and terminating in spaced gripping fingers, and being normally passable through said opening, illuminating means inserted and secured between and resiliently embraced by said gripping fingers, with the fingers being so spread by said inserted illuminating means as to so expand said inner portion as to preclude passage thereof through said opening, said illuminating means being mounted by the inner portion of said lens piece to extend parallel to the panel interior surface in a fixed position adjacent to but spaced from the panel interior surface and elongated resilient wire-like contact means carried on the panel interior surface and electrically connected to said illuminating means, said contact means having projecting portions in electrical contact with said switch conductors.

2. The switching device of claim 1 wherein the interior surface of said panel is provided with an elongated pocket disposed intermediate the illuminating means and the elongated contact means, said pocket having positioned therein a resistor interconnecting said illuminating means and said contact means.

3. The switching device of claim 2 wherein the pocket is defined by a pair of spaced flanges projecting from the panel interior surface; said flanges and panel being of molded unitary construction.

4. The switching device of claim 1 wherein the lens piece, the illuminating means, and the elongated contact means are carried by the panel of the cover assembly.

* * * * *